US009455532B2

(12) United States Patent
Ueda et al.

(10) Patent No.: US 9,455,532 B2
(45) Date of Patent: Sep. 27, 2016

(54) CONNECTOR

(71) Applicant: Japan Aviation Electronics Industry, Limited, Tokyo (JP)

(72) Inventors: Kouhei Ueda, Tokyo (JP); Yohei Yokoyama, Tokyo (JP); Masaaki Takaku, Tokyo (JP); Tatsuya Shioda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/717,385

(22) Filed: May 20, 2015

(65) Prior Publication Data

US 2016/0006198 A1 Jan. 7, 2016

(30) Foreign Application Priority Data

Jul. 4, 2014 (JP) ..... 2014-138321

(51) Int. Cl.
*H01R 13/6581* (2011.01)
*H01R 13/405* (2006.01)
*H01R 24/62* (2011.01)

(52) U.S. Cl.
CPC ..... *H01R 13/6581* (2013.01); *H01R 13/405* (2013.01); *H01R 24/62* (2013.01)

(58) Field of Classification Search
USPC ..... 439/607.35, 660, 701, 108, 607.28, 439/607.56
See application file for complete search history.

(56) References Cited

U.S. PATENT DOCUMENTS 6,398,587 B1 * 6/2002 Chen ..... H01R 12/7023 439/573
6,419,529 B1 * 7/2002 Shi ..... H01R 25/006 439/607.02
6,447,311 B1 * 9/2002 Hu ..... H01R 23/6873 439/108
6,863,569 B2 * 3/2005 Zhu ..... H01R 23/6873 439/607.23
7,086,901 B2 * 8/2006 Zhang ..... H01R 12/716 439/541.5
7,717,745 B2 * 5/2010 He ..... H01R 13/642 439/607.23
7,744,418 B2 * 6/2010 He ..... H01R 23/6873 439/607.35
7,798,854 B2 * 9/2010 Tanaka ..... H01R 13/6471 439/108
7,828,598 B2 * 11/2010 Wang ..... H01R 13/502 439/607.27
7,927,142 B2 * 4/2011 Wang ..... H01R 13/629 439/607.04
2011/0159746 A1 6/2011 He

FOREIGN PATENT DOCUMENTS

JP 2011-138775 A 7/2011

* cited by examiner

*Primary Examiner* — Alexander Gilman
(74) *Attorney, Agent, or Firm* — Muncy, Geissler, Olds & Lowe, P.C.

(57) ABSTRACT

A connector includes one or more contacts, an insulator that holds the one or more contacts, an outer shell that is made of metal and covers around the insulator except a front face part and a back face part of the insulator in a fitting direction of the connector with a counter connector, and a back shell that is made of metal, covers the back face part of the insulator and has held portions to be held by the insulator, the insulator having back shell holders that hold corresponding held portions of the back shell, thereby holding the back shell.

5 Claims, 5 Drawing Sheets

CONNECTOR

BACKGROUND OF THE INVENTION

The present invention relates to a connector, in particular, to a connector having a back shell.

Recently, electronic devices such as computers and mobile phones have been widely spread, and these electronic devices are normally equipped with connectors to be connected with outside devices to transmit electrical signals. A connector of this type desirably takes a measure against the electromagnetic interference (EMI) by means of a cylindrical metal shell covering around an insulator that holds a contact such that the transmitted electrical signals are prevented from being affected by electromagnetic waves from outside and that a peripheral electronic device is prevented from being affected by electromagnetic noise generated from the transmitted electrical signals.

However, a connector for high-speed transmission of electrical signals has involved a problem that the connector cannot be sufficiently prevented from being affected by electromagnetic waves only by a metal shell covering around the insulator except the front face part and the back face part of the insulator in the direction in which the connector is fitted (fitting direction of the connector).

In this regard, JP 2011-138775 A, for example, discloses a connector in which the rear part of a metal shell 1 is closed by a cover 2 formed of a metal plate as illustrated in FIG. 13.

A first insulator 3 and a second insulator 4 are put together to hold a plurality of first contacts 5 and a plurality of second contacts 6, the metal shell 1 covers around the first insulator 3 and the second insulator 4, and the cover 2 formed of a bent metal plate closes the rear part of the metal shell 1, as illustrated in FIG. 14.

However, since the cover 2 overlays the metal shell 1 to close the rear part thereof, there is a problem that the connector must increase in size for the size of the cover 2.

In addition, a contact for high-speed transmission desirably has a predetermined distance of a fixed value from the metal cover 2 in order to adjust impedance to stabilize transmission characteristics. However, the connector disclosed by JP 2011-138775 A, for example, in which the cover 2 overlays the metal shell 1 often experiences variation in the relative position of the first contacts 5 and the second contacts 6, held by the first insulator 3 and the second insulator 4, with respect to the cover 2 attached to the metal shell 1, whereby it is difficult to stabilize transmission characteristics.

SUMMARY OF THE INVENTION

The present invention has been made in order to solve the conventional problem described above and is aimed at providing a connector in a small size capable of achieving stable transmission characteristics as well as suppressing influence of electromagnetic waves.

A connector according to the present invention comprises one or more contacts, an insulator that holds the one or more contacts, an outer shell that is made of metal and covers around the insulator except a front face part and a back face part of the insulator in a fitting direction of the connector with a counter connector, and a back shell that is made of metal, covers the back face part of the insulator and has held portions to be held by the insulator, wherein the insulator has back shell holders that hold corresponding held portions of the back shell, thereby holding the back shell.

DETAILED DESCRIPTION OF THE INVENTION

An embodiment of the present invention will be described below based on the appended drawings.

Figure 1:
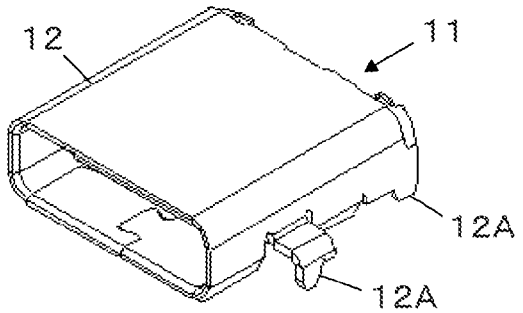
FIG. 1 is a perspective view showing a connector according to an embodiment of the present invention.
Figure 2:
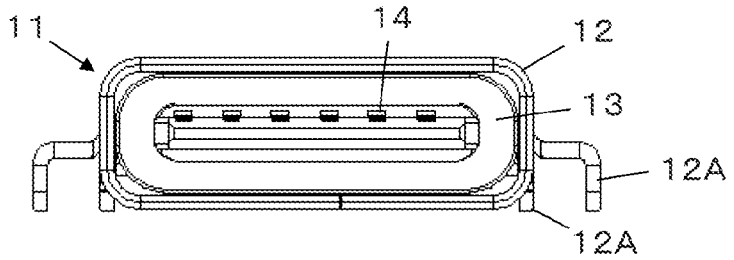
FIG. 2 is a front view showing the connector according to the embodiment.

FIG. 1 shows a connector 11 according to the embodiment. The connector 11 is a receptacle connector fixed to a board in an electronic device such as a mobile device or an information device and has an outer shell 12. As illustrated in FIG. 2, the outer shell 12 has an insulator 13 therein and the insulator 13 holds a plurality of contacts 14.

The outer shell 12 is made of metal, covers around the insulator 13 except a front face part and a back face part of the insulator 13 in a direction in which the connector 11 is fitted with a counter connector, and is provided with a plurality of shell leg portions 12A that project in the direction perpendicular to the fitting direction of the connector 11 and are used for mounting of the connector 13 on the board.

Figure 3:
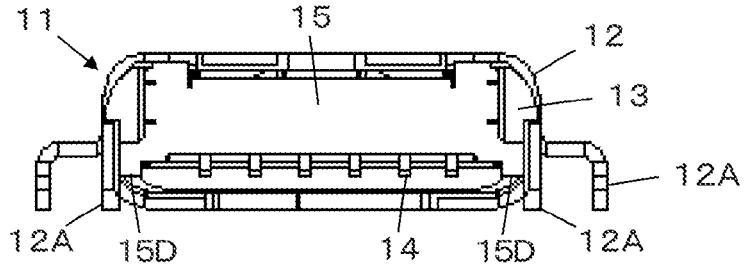
FIG. 3 is a rear view showing the connector according to the embodiment.

A back shell 15 made of metal is disposed at the back part of the connector 11 so as to cover the back face part of the insulator 13 as illustrated in FIG. 3. The back shell 15 is formed to be smaller than the outer periphery of the outer shell 12 when viewed from the fitting direction of the connector 11 with the counter connector and is disposed inside the outer shell 12.

Figure 4A:
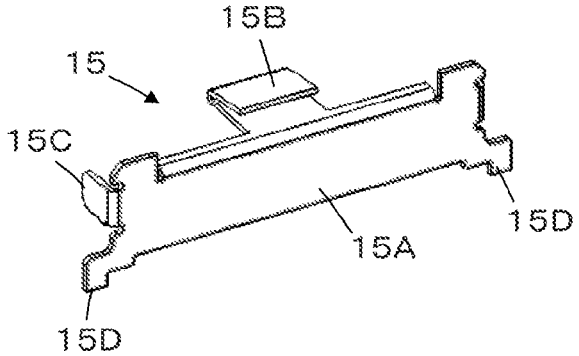
FIGS. 4A and 4B are a perspective view and a cross-sectional view each showing a back shell used in the connector according to the embodiment.

The back shell 15 has a back shell main body 15A in a substantially rectangular plate-shape to cover the back face part of the insulator 13, and the back shell main body 15A is provided with a spring contact portion 15B that projects from an upper edge of the back shell main body 15A in the direction perpendicular thereto as illustrated in FIG. 4A. In addition, a pair of claw portions 15C each in a substantially rectangular shape are formed at lateral opposite ends of the back shell main body 15A so as to project in the same direction as the spring contact portion 15B and to serve as held portions to be held by the insulator 13. Moreover, a pair of butt-joint terminals 15D are formed at lower parts of lateral opposite ends of the back shell main body 15A so as to project downward in plane with the back shell main body 15A.

Figure 4B:
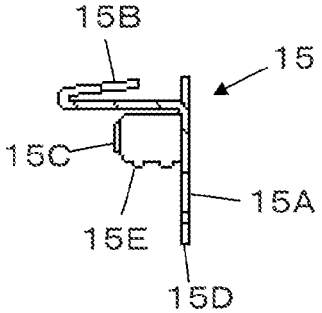

FIG. 4B illustrates each of the claw portions 15C having two projections 15E projecting downward.

Figure 5:
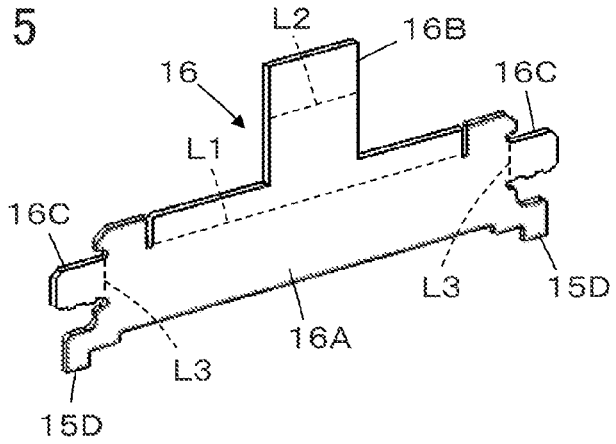
FIG. 5 is a development view showing the back shell used in the connector according to the embodiment.

The back shell 15 having such constitution can be produced from a metal plate 16 that is cut out in a shape, as illustrated in FIG. 5, including a plate portion 16A corresponding to the back shell main body 15A, a projection portion 16B provided at the upper part of the plate portion 16A, and a pair of projection portions 16C provided at lateral opposite ends of the plate portion 16A, and that is then subjected to a bending process. More specifically, the projection portion 16B is bent at bending line L1 and folded at folding line L2 parallel to each other to thereby form the spring contact portion 15B, and the pair of projection portions 16C are bent at bending lines L3 to thereby form the pair of claw portions 15C that are disposed at lateral opposite ends of the back shell main body 15A. The pair of butt-joint terminals 15D are provided at the lower parts of lateral opposite ends of the plate portion 16A corresponding to the back shell main body 15A at the beginning when the metal plate 16 is cut out.

Figure 6:
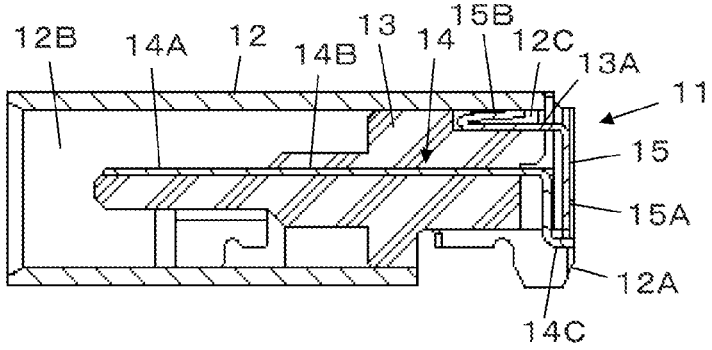
FIG. 6 is a cross-sectional view showing the connector according to the embodiment.

As illustrated in FIG. 6, a counter-connector accommodation portion 12B to which the counter connector is inserted is formed at the front end inside the outer shell 12, and the insulator 13 is accommodated at the rear end inside the outer shell 12.

A step portion 13A is formed at the upper rear end of the insulator 13, and the step portion 13A and an upper inner surface at the rear end of the outer shell 12 constitute therebetween a spring-contact insertion portion 12C. With the spring contact portion 15B of the back shell 15 inserted into the spring-contact insertion portion 12C that is formed between the upper inner surface at the rear end of the outer shell 12 and the upper rear end of the insulator 13, the back shell 15 is disposed at the back face part of the insulator 13. The spring contact portion 15B elastically deforms in the spring-contact insertion portion 12C to be pressed against the upper inner surface at the rear end of the outer shell 12, whereby the outer shell 12 is electrically connected to the back shell 15.

Each of the contacts 14 held by the insulator 13 has a contact portion 14A to be exposed to the counter-connector accommodation portion 12B, an insulator-fixing portion 14B to be embedded in and fixed to the insulator 13, and a board-mounting portion 14C to be mounted on and fixed to the board (not shown), respectively, at the front end, in the middle, and at the rear end of the contact 14. The contact portion 14A comes in contact with a contact of the counter connector that is inserted into the counter-connector accommodation portion 12B. The contact portion 14A and the insulator-fixing portion 14B extend along the same plane to form a plate shape. The board-mounting portion 14C to be connected to the insulator-fixing portion 14B bends from the insulator-fixing portion 14B and projects toward the rear part of the insulator 13 to be exposed under the back shell 15.

Figure 7:
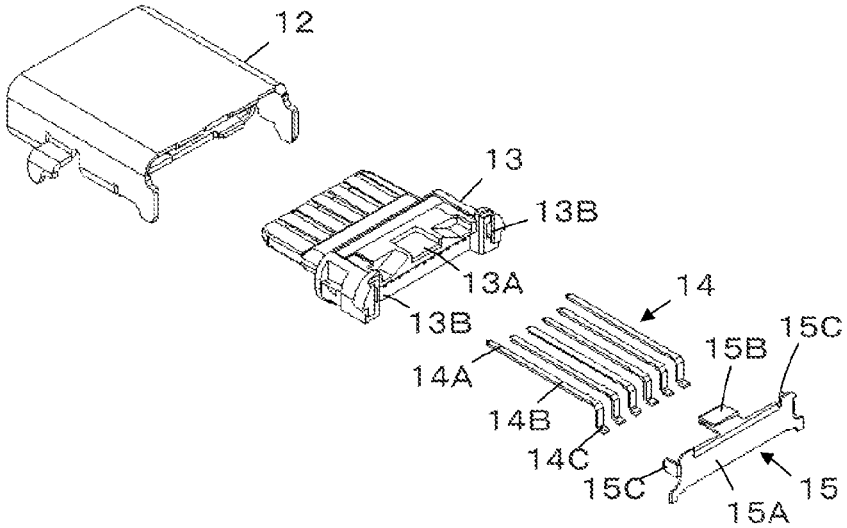
FIG. 7 is an assembly view showing the connector according to the embodiment.

As illustrated in FIG. 7, the connector 11 can be produced through the processes of insert-molding the signal contacts 14 with resin that forms the insulator 13 such that the insulator-fixing portions 14B of the signal contacts 14 are embedded in the insulator 13, then pressing the insulator 13 into the outer shell 12, and attaching the back shell 15 at the back face part of the insulator 13.

Figure 8:
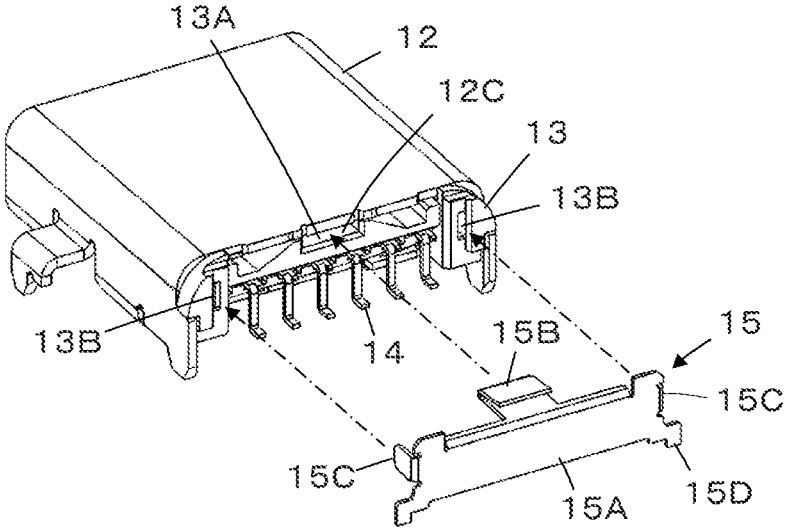
FIG. 8 is a perspective view showing how the back shell is attached to an insulator.

The back face part of the insulator 13 is provided at lateral opposite ends thereof with claw-portion insertion holes 13B that serve as back shell holders, and the back shell 15 is attached to the insulator 13 by means of the claw-portion insertion holes 13B. That is, as illustrated in FIG. 8, the spring contact portion 15B is inserted into the spring contact insertion portion 12C formed between the upper inner surface at the rear end of the outer shell 12 and the step portion 13A of the insulator 13 while the pair of claw portions 15C are pressed into the claw-portion insertion holes 13B respectively formed at the lateral opposite ends of the back face part of the insulator 13, whereby the back shell 15 is held and fixed by the insulator 13.

Figure 9:
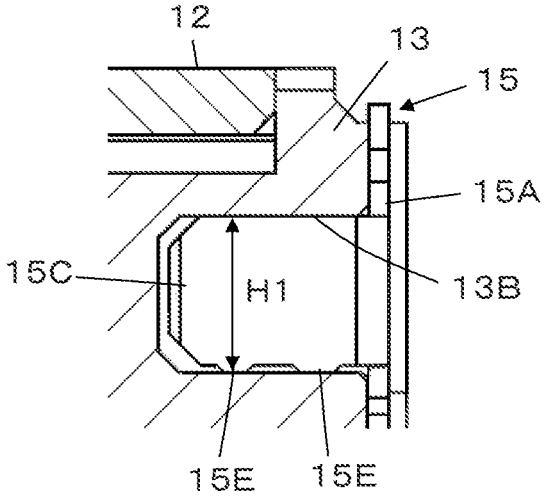
FIG. 9 is a partially-enlarged cross-sectional view showing an attachment portion of the back shell to be attached to the insulator.

In this process, since each of the claw-portion insertion holes 13B of the insulator 13 has a height slightly smaller than a height H1 of a part of the claw portion 15C of the back shell 15 where one of the projections 15E is formed as illustrated in FIG. 9, when the claw portion 15C is pressed into the claw-portion insertion hole 13B, the projection 15E is pressed against the inner wall of the claw-portion insertion hole 13B so as to bite into the inner wall of the claw-portion insertion hole 13B, whereby the back shell 15 is firmly held by the insulator 13.

Moreover, since the claw portions 15C are pressed into the claw-portion insertion holes 13B until the surface of the back shell main body 15A comes in contact with the rear face of the insulator 13, the relative position of the back shell 15 with respect to the insulator 13 can be stabilized. In other words, the relative position of the back shell 15 with respect to the contacts 14 held by the insulator 13 can be stabilized.

In addition, when the back shell 15 is attached to the back face part of the insulator 13, as illustrated in FIG. 3, the pair of butt-joint terminals 15D of the back shell 15 are positioned adjacent to the corresponding shell leg portions 12A of the outer shell 12.

Figure 10:
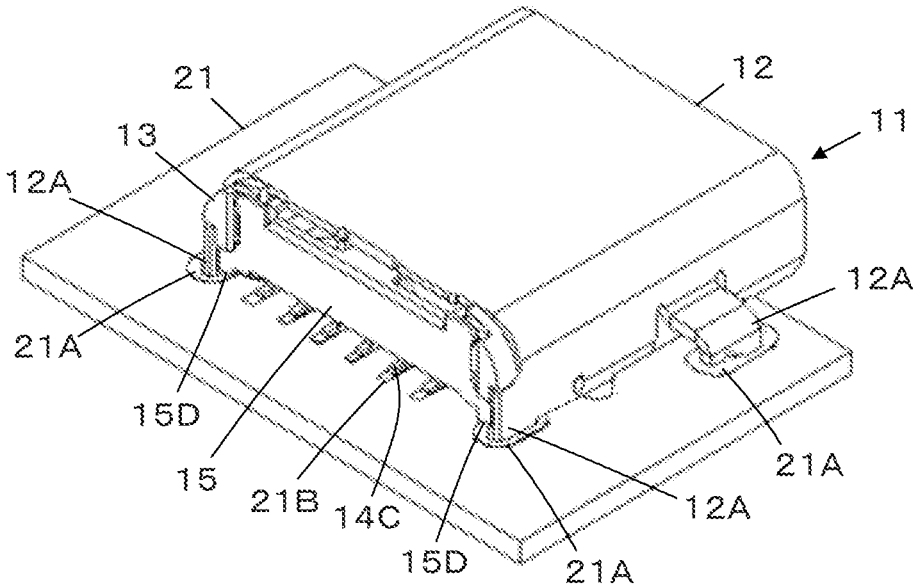
FIG. 10 is a perspective view showing the connector according to the embodiment when mounted on a board.
Figure 11:
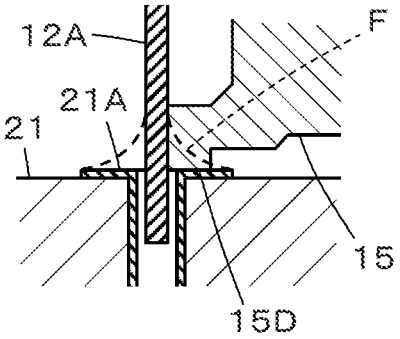
FIG. 11 is a cross-sectional view showing a butt-joint terminal of the back shell when mounted and fixed on the board.

The connector 11 is used as being mounted on the board 21 as illustrated in FIG. 10. The shell leg portions 12A of the outer shell 12 are inserted into their corresponding through holes 21A formed in the board 21, mounted and fixed by means of soldering, whereby the outer shell 12 is mounted on the board 21. In this process, as illustrated in FIG. 11, since each of the butt-joint terminals 15D of the back shell 15 is located adjacent to the corresponding shell leg portion 12A of the outer shell 12, when the shell leg portion 12A of the outer shell 12 is soldered at the corresponding through hole 21A in the board 21, a solder fillet F is formed and fixes the butt-joint terminal 15D to a pad at the through hole 21A on the board surface side.

That is, through the process of soldering the shell leg portions 12A of the outer shell 12 at their corresponding through holes 21A of the board 21, the butt-joint terminals 15D of the back shell 15D can be connected to the corresponding through holes 21A in the board 21 at the same time as the mounting of the outer shell 12 on the board 21. Accordingly, the outer shell 12 and the back shell 15 are connected to the ground potential via the through holes 21A in the board 21.

Figure 12:
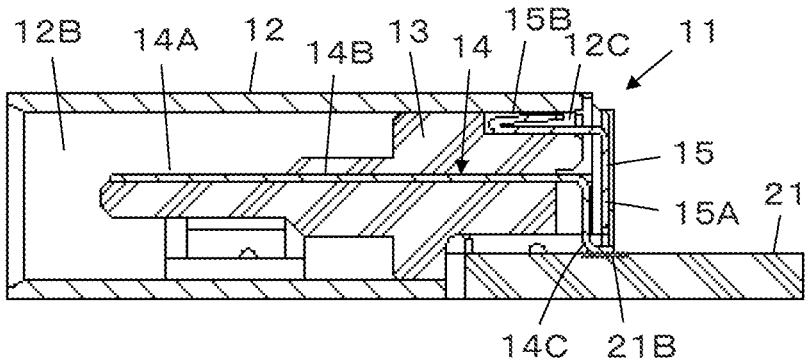
FIG. 12 is a cross-sectional view showing the connector according to the embodiment when mounted on the board.
Figure 13:
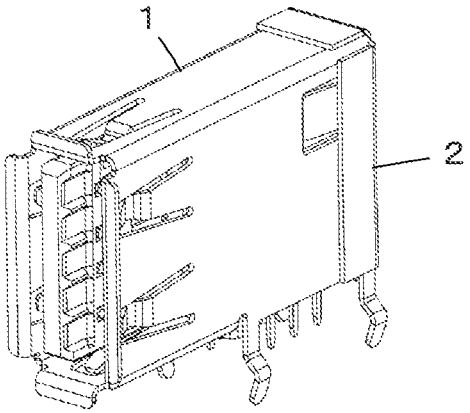
FIG. 13 is a perspective view showing a conventional connector.
Figure 14:
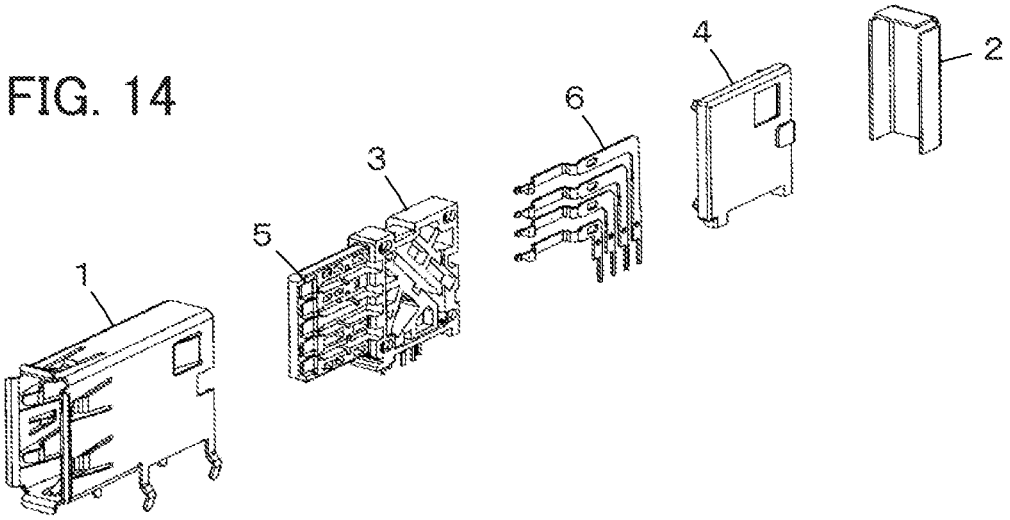
FIG. 14 is an assembly view showing the conventional connector.

In addition, as illustrated in FIG. 12, the board mounting portions 14C of the signal contacts 14 are soldered to the corresponding connection pads 21B to be thereby mounted and fixed on the board 21. For example, the board mounting portions 14C are connected to an electronic circuit (not shown) mounted on the board 21 in this manner.

Accordingly, the connector, in which the signal contacts 14 are held by the insulator 13 and the outer shell 12 covers around the insulator 13 except the front part and the back face part thereof while the back shell 15 covers the back face part of the insulator 13, can transmit electrical signals with the suppressed influence of electromagnetic waves.

Since the back shell 15 is fixed to the insulator 13 with the pair of claw portions 15C pressed into the claw-portion insertion holes 13B formed at lateral opposite sides of the back face part of the insulator 13 and is formed to be smaller than the outer periphery of the outer shell 12 when viewed from the fitting direction of the connector 11 with the counter connector so as to be disposed inside the outer shell 12, the small-sized connector 11 can be realized.

Moreover, since the back shell 15 is fixed not to the outer shell 12 but to the back face part of the insulator 13, the relative position of the back shell 15 with respect to the contacts 14 held by the insulator 13 can be stabilized. As a result, the connector 11 can obtain stable transmission characteristics even when performing high-speed transmission.

In addition, since the back shell 15 is configured not to overlay the outer shell 12 but to be disposed inside the outer shell 12 when viewed from the fitting direction of the connector 11, the back shell 15 can be readily produced regardless of the shape of the outer shell 12 using the back shell main body 15A made of a metal plate that is cut out in a shape corresponding to the outer shell 12. Even in an example where the outer shell 12 has a rounded shape, the back shell 15 to be disposed inside the outer shell 12 when viewed from the fitting direction of the connector 11 can be produced using the back shell main body 15A made of a metal plate that is cut out in a rounded shape corresponding to the outer shell 12.

In place of providing the back shell 15 with the butt-joint terminals 15D that would be located adjacent to their corresponding shell leg portions 12A of the outer shell 12, back shell leg portions can be formed apart from their corresponding shell leg portions 12A of the outer shell 12 and soldered at dedicated through holes or connection pads formed on the board 21. However, the butt-joint terminals 15D of the back shell 15 are preferably disposed adjacent to the corresponding shell leg portions 12A of the outer shell 12 and fixed to pads at the through holes 21A on the board surface side with the solder fillets F formed when the shell leg portions 12A are soldered to the through holes 21A in the board 21 like in the embodiment described above, thereby eliminating the need of forming the dedicated through holes or connection pads for the back shell 15 on the board 21, saving the space therefor, and enabling connection of the back shell 15 to the board 21 at the time of mounting of the outer shell 12 on the board 21.

Moreover, while the back shell 15 is electrically connected to the outer shell 12 with the spring contact portion 15B of the back shell 15 pressed against the upper inner wall at the rear end of the outer shell 12 in the embodiment described above, this is not the sole case and the back shell 15 can be, for example, welded to the outer shell 12 to be electrically connected.

Furthermore, while the pair of claw portions 15C of the back shell 15 are pressed into the pair of claw-portion insertion holes 13B of the insulator 13 in the embodiment described above, the back shell 15 can also be fixed to the insulator 13 by various methods other than press-fitting, as long as the back shell 15 is held by the insulator 13.

The number of contacts 14 to be held by the insulator 13 is not particularly limited and can be any number of one or more.

What is claimed is:

1. A connector comprising:

one or more contacts;

an insulator that holds the one or more contacts;

an outer shell that is made of metal and covers around the insulator except a front face part and a back face part of the insulator in a fitting direction of the connector with a counter connector; and a back shell that is made of metal, covers the back face part of the insulator and has held portions to be held by the insulator, the held portions having claw portions projecting toward the insulator, wherein the insulator has back shell holders that comprise claw-portion insertion holes formed at the back face part of the insulator and hold corresponding held portions of the back shell, wherein the claw portions of the back shell are pressed into the claw-portion insertion holes of the insulator, whereby the back shell is held by the insulator.

2. The connector according to claim 1, wherein the back shell has butt-joint terminals to be mounted and fixed on a board.

3. The connector according to claim 2, wherein the outer shell has leg portions to be inserted into corresponding through holes formed in the board and fixed by soldering, and wherein the butt-joint terminals of the back shell are respectively disposed adjacent to the leg portions of the outer shell and fixed to pads at the through holes on a surface side of the board with solder fillets formed when the leg portions of the outer shell are soldered to the through holes in the board.

4. The connector according to claim 1, wherein the back shell has a spring contact portion to be connected to an inner surface of the outer shell.

5. The connector according to claim 1, wherein the back shell is disposed inside the outer shell when viewed in the fitting direction of the connector with the counter connector.

* * * * *